United States Patent [19]

Miyoshi et al.

[11] Patent Number: 4,838,164

[45] Date of Patent: Jun. 13, 1989

[54] INK-FURNISHING APPARATUS

[75] Inventors: Masahiko Miyoshi, Ayase; Masayoshi Sato, Kawasaki, both of Japan

[73] Assignee: Kabushiki Kaisha Tokyo Kikai Seisakusho, Tokyo, Japan

[21] Appl. No.: 888,562

[22] Filed: Jul. 22, 1986

[51] Int. Cl.[4] ..... B41F 31/02

[52] U.S. Cl. ..... 101/365; 101/366

[58] Field of Search ..... 101/335, 358, 336, 340, 101/341, 342, 343, 366, 365

[56] References Cited

U.S. PATENT DOCUMENTS

| | | | |
|---|---|---|---|
| 651,397 | 6/1900 | Studebaker | 101/335 X |
| 1,713,655 | 5/1929 | Halliwell | 101/366 X |
| 2,041,740 | 5/1936 | Beckman | 101/335 |
| 2,085,325 | 6/1937 | Miller | 101/535 |
| 3,002,866 | 10/1961 | Gortrell et al. | 101/335 X |
| 3,055,297 | 9/1962 | Leeds | 101/335 X |
| 3,096,885 | 7/1962 | Neal | 101/366 X |
| 3,418,935 | 12/1968 | Adams | 101/335 |
| 3,796,155 | 3/1974 | Dvj;ilrnort | 101/366 X |
| 4,201,597 | 8/1981 | Dressler | 101/366 X |

FOREIGN PATENT DOCUMENTS

| | | | |
|---|---|---|---|
| 6095934 | 8/1981 | Japan | 101/335 |
| 87365 | 5/1982 | Japan | 101/335 |
| 461785 | 2/1937 | United Kingdom | 101/335 |
| 1087809 | 10/1967 | United Kingdom | 101/335 |

OTHER PUBLICATIONS

"General Printing Techniques", ed. by Insatsu Gijutsu Ippan Kankokai, published May 10, 1968, pp. 357–359.

"Newspaper Printing": Printing; published Oct. 31, 1980 from Nihon Shinbun Kyokai, edited by Nihon Shinbun Kyokai, pp. 208–210.

"Printing Technology Handbook"; published May 1, 1983 from Gihodo, edited by Nihon Insatsu Gakkai, pp. 121–145.

*Primary Examiner*—Edgar S. Burr

*Assistant Examiner*—James R. M. Daniel

*Attorney, Agent, or Firm*—R. A. Giangiorgi

[57] ABSTRACT

An ink-furnishing apparatus for continuously supplying ink to an ink cylinder from an ink rail even during high speed operation of the ink cylinder. An ink transfer surface of the ink rail has a first solid substance which is superior to a cast iron constituting the ink rail in terms of separation of ink therefrom. A peripheral surface of the ink cylinder has a second solid substance which is superior to the first solid substance in terms of adhesion of the ink thereon. While said first solid substance has a surface which makes a larger contact angle with a surface of the ink than a contact angle made between the surface of the ink and the surface of cast iron constituting said ink rail, said second solid substance has a surface which makes a smaller contact angle with the surface of the ink than said larger contact angle.

5 Claims, 1 Drawing Sheet

INK-FURNISHING APPARATUS

BACKGROUND OF THE INVENTION

1. Field of the Invention

The present invention relates to an apparatus for supplying ink to an ink cylinder of a printer through an ink rail.

2. Description of the Related Art

An ink-furnishing method wherein ink is supplied to an ink cylinder of a printer through an ink rail has already been known as a particularly advantageous means which enables ink to be satisfactorily supplied even during a high-speed operation of a printer (see "General Printing Techniques" (revised edition), published by Sangyo Tosho, pp. 357 to 359, and "News Printing (the volume title: Printing)" (revised edition), published by Nihon Shinbun Kyokai, pp. 208 to 210).

The essential part of such ink rail is a concave surface having a curvature substantially equal to the radius of curvature of the peripheral surface of the associated ink cylinder. The ink rail is disposed in such a manner that this concave surface opposes the peripheral surface of the ink cylinder across a slight gap, e.g., 0.2 mm, so that about ¼ of the entire periphery of the ink cylinder is constantly covered with the concave surface over the whole area in the axial direction. Accordingly, when an ink is delivered into the above-described gap from a tank by means of a pump through a row of discharge openings provided in the concave surface, the ink is attached to the peripheral surface of the ink cylinder and spread over the entire periphery of the cylinder as it is rotated.

A typical conventional ink rail is made of a cast iron material (JIS G5501 FC20), and the above-described concave surface for transferring ink is formed by smooth-finishing the surface of the cast iron material.

The kinds of ink which is transferred from such ink rail to the associated ink cylinder may be roughly classified into oleaginous ink and water-color ink on the basis of the media, i.e., vehicles, employed therefor.

The phenomenon that ink adheres to the surface of a solid substance is defined as "wetting" in terms of the interfacial chemistry, and the angle of contact between the surface of ink as a liquid and the surface of a solid substance is known as "contact angle". The smaller the contact angle, the smaller the surface tension of the liquid concerned, and the better the wetting of the solid surface; the larger the contact angle, the larger the surface tension of the liquid, and the worse the wetting of the solid surface (see "Printing Technology Handbook", edited by Nihon Insatsu Gakkai, published from Gihodo, pp. 121 to 145, and "Metallic Functional Surface", written by Yukio Murakawa, published from Kindai Henshu Sha, pp. 131 to 155).

As described above, the ink rail type ink-furnishing method has originally been developed for the purpose of increasing the operation speed of printers and of improving the printing effectiveness during the running of a printer over a long period of time.

However, when the operation speed of printers is increased to an ultra-high speed level in order to cope with the demand for mass printing in recent years, the conventional cast iron ink rail suffers from the following problem. Namely, the speed of transfer of ink from the cast iron surface to the peripheral surface of the ink cylinder cannot catch up with the speed of the printer, so that the supply of ink is interrupted, resulting in mottling of ink on the peripheral surface of the cylinder.

This phenomenon is particularly noticeable in offset presses using an oleaginous ink of high viscosity, but the occurrence of such phenomenon is also found in printing operations using a water-color ink of relatively low viscosity.

SUMMARY OF THE INVENTION

In view of the above-described circumstances, it is a primary object of the present invention to provide an ink-furnishing apparatus using an ink rail which involves no fear of the supply of ink being interrupted even during an ultrahigh speed operation of a printer.

To this end, the present invention provides an ink-furnishing apparatus comprising an ink rail having an ink transfer surface which is surface-treated with a solid substance having a larger contact angle than the contact angle made between the surface of ink and the surface of a cast iron constituting the ink transfer surface. Alternatively, in addition to the above-described arrangement, the peripheral surface of an ink cylinder provided in opposing relation to the ink transfer surface is surface-treated with a solid substance having a smaller contact angle than that of the solid substance which is used to surface-treat the ink transfer surface.

Since the contact angle between the surface of ink and the ink transfer surface is made larger than that in the case of the conventional cast iron surface, the surface tension of the ink attached to the ink transfer surface is increased, so that the ink adhesion or wetting properties become poor or inferior. In consequence, it is easy for the ink to separate therefrom so as to be transferred to the ink cylinder, which means that the transfer of the ink is smoothly continued even during a high-speed printing operation.

In addition to the above-described arrangement for enabling ink to be readily separated from the ink transfer surface so as to be effectively transferred to the ink cylinder, the contact angle between the surface of ink and the peripheral surface of the ink cylinder is made smaller than that in the case of the ink transfer surface. Therefore, the surface tension of the ink attached to the peripheral surface of the ink cylinder is lowered, and the ink adhesion or wetting properties are consequently bettered. Accordingly, it becomes easy for the ink to be attached to the peripheral surface of the ink cylinder, so that the transfer and supply of the ink is smoothly continued even during a high-speed printing operation.

The above and other objects, features and advantages of the present invention will become clear from the following description of the preferred embodiment thereof, taken in conjunction with the accompanying drawings.

DESCRIPTION OF THE PREFERRED EMBODIMENT

The present invention will be described hereinunder in detail with reference to the accompanying drawings.

Figure 1:
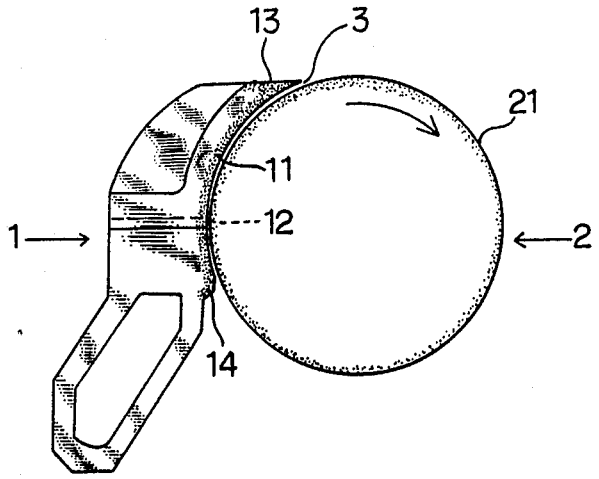
FIG. 1 is a side view of one embodiment of the ink-furnishing apparatus according to the present invention.
Figure 2:
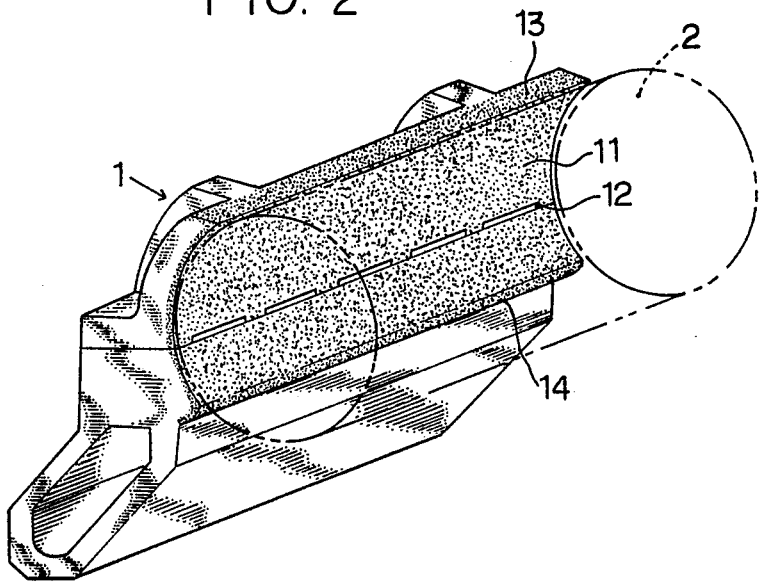
FIG. 2 is a perspective view of the embodiment, which particularly shows the ink transfer surface of the ink rail shown in FIG. 1.

Referring to FIGS. 1 and 2, ink is supplied to an ink cylinder 2 through an ink rail 1. The ink cylinder 2 has an ink receiving peripheral surface 21, and the ink rail 1 has an ink transfer concave surface 11 disposed in opposing relation to the peripheral surface 21 across a gap 3 of e.g., 0.2 mm, the concave surface 11 having a curvature substantially equal to the radius of curvature of the peripheral surface 21. Ink is delivered into the gap 3 from a tank (not shown) by means of a pump (not shown) through a row of discharge openings 12 provided in the ink transfer surface 11, and while doing so, the ink cylinder 2 is rotated in the arrowed direction (see FIG. 1). In consequence, the ink within the gap 3 is attached to the peripheral surface 21 of the ink cylinder 2 and also uniformly attached to the ink transfer surface 11 of the ink rail 1. Thus, as the ink cylinder 2 rotates, the ink is gradually transferred to the ink receiving peripheral surface 21 from the ink transfer surface 11. The ink rail 1 is made of a cast iron (JIS G501 FC20). The above-described arrangement and operation have heretofore been known.

According to the present invention, the ink transfer surface 11 of the ink rail 1 in the above-described arrangement is surface-treated with a solid substance (shown by small dots) having a larger contact angle than the contact angle made between the surface of the ink and the surface of the cast iron. Examples of solid substances having such nature include, when an oleaginous ink is employed, substances which are inferior to the cast iron in terms of lipophilic nature, e.g, chromium, whereas, when a water-color ink is employed, substances which are inferior to the cast iron in terms of hydrophilic nature, e.g., polytetrafluoroethylene (trade name: Teflon T-30), are preferably employed.

Since ink may be attached to the upper and lower surfaces 13 and 14 of the ink rail 1 which ar adjacent to the ink transfer surface 11, it is preferable to surface-treat also these surfaces with the same material as that for the ink transfer surface 11.

As means for the surface treatment, it is possible to employ any conventional method, such as plating, spray coating, welding, coating, lining, etc. It is only necessary for the treated surface to have a smooth-finished surface resultingly.

Thus, in the present invention, a solid substance which is relatively inferior in lipophilic nature is employed in the case of an oleaginous ink, while a solid substance which is relatively inferior in hydrophilic nature is employed in the case of a water-color ink, and the surface tension of the ink is thereby increased in either case to make the ink adhesion or wetting properties worse. Therefore, the separation of the ink from the ink transfer surface 11 is promoted as compared with that in the case of the conventional ink transfer surface made of cast iron.

According to the present invention, in addition to the above-described arrangement the peripheral surface 21 of the ink cylinder 2 disposed in opposing relation to the ink transfer surface 11 of the ink rail 1 is surface-treated with a solid substance (shown by small dots) having a smaller contact angle than that of the solid substance employed for the ink transfer surface 11.

When an oleaginous ink is used, for example, copper may be employed as a solid substance having the above-described nature; when a water-color ink is used, for example, chromium may be employed.

Thus, when an oleaginous ink is used, the peripheral surface 21 of the ink cylinder 21 is surface-treated with a solid substance which is superior to the substance constituting the ink transfer surface 11 in terms of lipophilic nature, while, when a water-color ink is used, a solid substance which is superior to the latter in terms of the hydrophilic nature is employed for surface-treating the peripheral surface 21, and the surface tension of the ink is thereby made lower than that at the ink transfer surface 11 in either case to better the ink adhesion or wetting properties. Accordingly, the adhesion of the ink to the peripheral surface 2 of the ink cylinder 2 is promoted.

In other words, there is provided a large difference between the ink adhesion at the ink rail 1 for transferring ink and that at the ink cylinder 2 for receiving the transferred ink. In consequence, the ink which is in contact with both the ink rail 1 and the ink cylinder 2 is, as the ink cylinder 2 rotates, effectively transferred to the peripheral surface 21 of the ink cylinder 2 which has better ink adhesion and therefore allows the ink to be readily attached thereto from the ink transfer surface 11 of the ink rail 1 which has inferior ink adhesion and therefore allows the ink to be readily separated therefrom.

As has been described above in detail, according to the present invention, the ink transfer surface 11 of the ink rail 1 is surface-treated with a solid substance having a larger contact angle than that of a cast iron constituting the ink rail 1 to increase the surface tension of the ink and weaken the ink adhesion, thereby allowing the ink to be readily and effectively separated therefrom. Alternatively, in addition to this arrangement, the peripheral surface 21 of the ink cylinder 2 is surface-treated with a solid substance having a smaller contact angle than that of the above-described surface-treating substance to lower the surface tension of the ink and intensify the ink adhesion, thereby succeeding in encouraging the ink to be separated from the ink transfer surface 11 so as to be effectively transferred to the peripheral surface 21 of the ink cylinder 2. Accordingly, even when the operation speed of printers is increased, it is possible to satisfactorily cope with an ultra-high speed printing operation and effect a smooth ink-furnishing operation.

Although the present invention has been described through specific terms, it should be noted here that the present invention is not necessarily limited to the above-described embodiment, and various changes and modifications may be imparted thereto without departing from the scope of the invention which is limited solely by the appended claims.

What is claimed is:

1. An ink furnishing comprising:

an ink rail having a concave ink transfer surface formed of cast iron;

an ink cylinder having a peripheral surface cooperating with said concave surface to form a gap therebetween;

means for furnishing ink to said ink rail and said concave ink transfer surface for thus applying said ink to said ink cylinder surface:

said ink rail having a cast iron surface treated with a first solid substance;

said treated cast iron surface having a decreased wetting property and a decreased affinity for said ink when compared with the wetting property of an untreated cast iron surface;

said treated cast iron surface functioning to enable an increased ink surface tension and thus a greater contact angle of said ink relative to said treated surface as compared with the ink surface tension and contact angle of said ink relative to an untreated cast iron surface;

said ink cylinder peripheral surface having a surface treated with a second solid substance; said treated ink cylinder surface having an increased wetting property and an increased affinity for said ink when compared with the wetting property of said treated cast iron ink transfer surface;

said treated ink cylinder surface functioning to enable a decreased ink surface tension and thus a lesser contact angle of said ink relative to said treated cylinder surface as compared with said ink surface tension and contact angle of said ink relative to said treated cast iron surface.

2. An ink-furnishing apparatus according to claim 1, wherein, when an oleaginous ink is used, a first solid substance which is inferior to the cast iron in terms of lipophilic nature is employed to surface-treat said ink transfer surface, and a second solid substance which is superior to the first solid substance in terms of lipophilic nature is employed to surface-treat said peripheral surface of said ink cylinder.

3. An ink-furnishing apparatus according to claim 2, wherein, chromium is employed as a first solid substance, and cooper is employed as a second solid substance.

4. An ink-furnishing apparatus according to claim 1, wherein, when a water-color ink is used, a first solid substance which is inferior to the cast iron in terms of hydrophilic nature is employed to surface-treat said ink transfer surface, and a second solid substance which is superior to the first solid substance in terms of hydrophilic nature is employed to surface-treat said peripheral surface.

5. An ink-furnishing apparatus according to claim 4, wherein, polytetrafluoroethylene is employed as a first solid substance for surface-treating said ink transfer surface, and chromium is employed as a second solid substance.

* * * * *